US007623040B1

(12) United States Patent
Cote

(10) Patent No.: US 7,623,040 B1
(45) Date of Patent: Nov. 24, 2009

(54) SMART BLISTER PACK

(75) Inventor: Andre Cote, Williamstown, NJ (US)

(73) Assignee: Checkpoint Systems, Inc., Thorofare, NJ (US)

( * ) Notice: Subject to any disclaimer, the term of this patent is extended or adjusted under 35 U.S.C. 154(b) by 369 days.

(21) Appl. No.: 11/549,795

(22) Filed: Oct. 16, 2006

Related U.S. Application Data

(60) Provisional application No. 60/736,532, filed on Nov. 14, 2005.

(51) Int. Cl.
*G08B 13/14* (2006.01)

(52) U.S. Cl. ..... 340/572.8; 340/572.9; 206/534.1; 206/471

(58) Field of Classification Search ..... 340/572.8, 340/572.1–572.7, 572.9; 206/531, 534.1, 206/469, 528, 530, 532, 534, 538, 539, 471
See application file for complete search history.

(56) References Cited

U.S. PATENT DOCUMENTS 4,567,473 A 1/1986 Lichtblau
4,658,264 A 4/1987 Baker
4,835,524 A 5/1989 Lamond et al.
4,900,386 A * 2/1990 Richter-Jorgensen ..... 156/250
5,108,822 A 4/1992 Imaichi et al.
5,172,461 A 12/1992 Pichl
5,709,472 A * 1/1998 Prusik et al. ..... 374/106
5,833,603 A * 11/1998 Kovacs et al. ..... 600/317
5,881,719 A * 3/1999 Gottenauer et al. .... 128/203.15
5,953,085 A * 9/1999 Shimada ..... 349/39
6,100,804 A 8/2000 Brady et al.
6,177,871 B1 1/2001 Rasband
6,181,287 B1 1/2001 Beigel
6,320,556 B1 11/2001 Cyman et al.
6,665,193 B1 12/2003 Chung et al.
6,940,408 B2 9/2005 Ferguson et al.
7,109,867 B2 9/2006 Forster
7,119,685 B2 10/2006 Eckstein et al.
7,121,410 B2 * 10/2006 Rohrmus et al. ..... 206/531

(Continued)

FOREIGN PATENT DOCUMENTS

DE 19739438 A1 3/1999

(Continued)

OTHER PUBLICATIONS

International Search Report, PCT/US2006/060791, dated Jul. 11, 2007.

*Primary Examiner*—Daniel Previl
(74) *Attorney, Agent, or Firm*—Caesar, Rivise, Bernstein, Cohen & Pokotilow, Ltd.

(57) ABSTRACT

A blister pack having at least one security tag formed from the metal layer of the blister pack. In one embodiment, the security tag is a detached portion of the metal layer that is entrenched in a corresponding channel in the plastic layer of the blister pack and which is then completed by electrically coupling a capacitor strap or chip strap to a gapped portion of the entrenched aluminum layer. Another embodiment also forms the security tag from the metal layer but the coil or antenna of the security tag is formed as part of the process of sealing the metal layer to the plastic layer. A capacitor strap or chip strap is then electrically coupled to a gapped portion of the coil or antenna.

24 Claims, 7 Drawing Sheets

U.S. PATENT DOCUMENTS

| | | | | |
|---|---|---|---|---|
| 7,158,033 | B2 * | 1/2007 | Forster | 340/572.1 |
| 2005/0274644 | A1 * | 12/2005 | Williams-Hartman | 206/531 |

FOREIGN PATENT DOCUMENTS

| | | | |
|---|---|---|---|
| EP | 0292827 | | 11/1988 |
| JP | S58-154291 | | 9/1983 |
| WO | 98/37740 | | 8/1998 |
| WO | 01/63368 | | 8/2001 |
| WO | WO 01/63368 | * | 8/2001 |

* cited by examiner

FIG.10
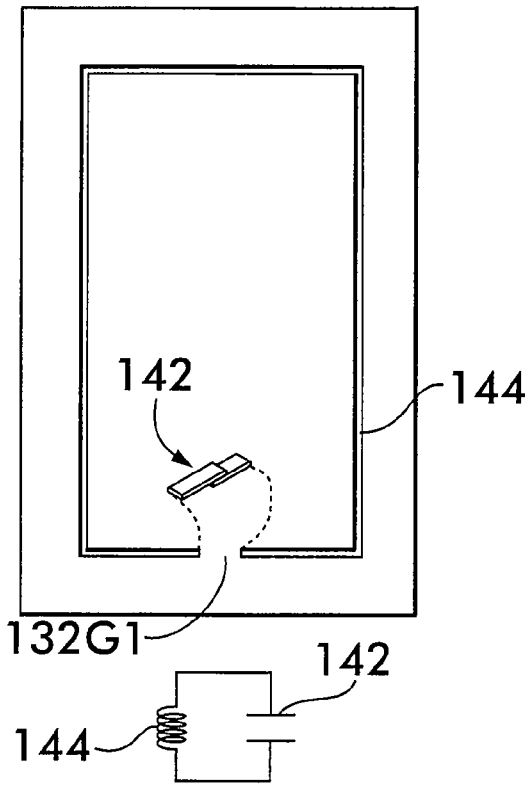
FIG.10A
FIG.11
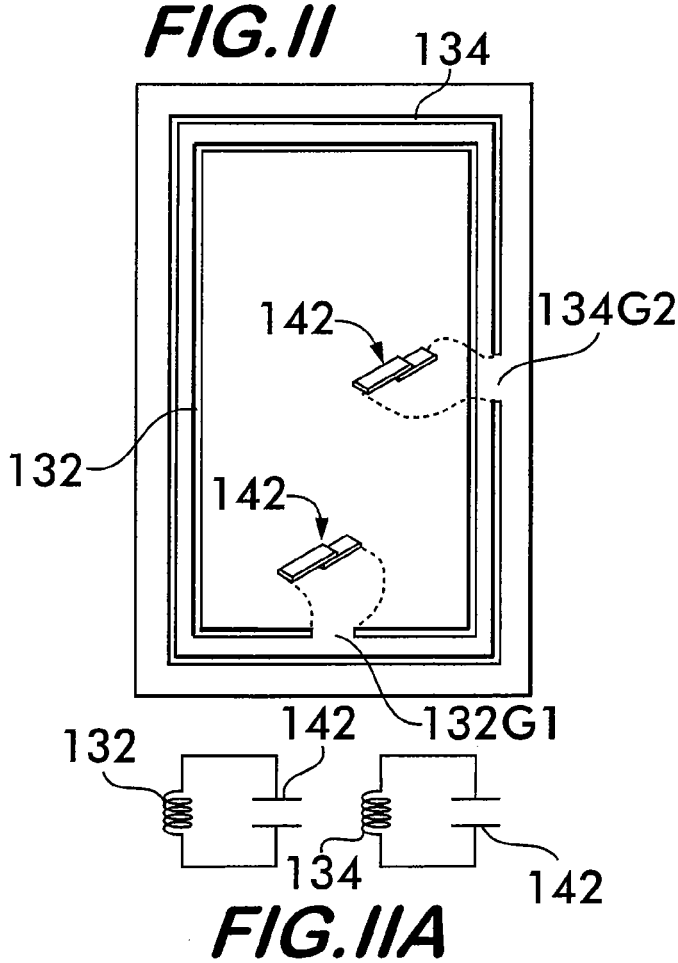
FIG.11A

FIG.12
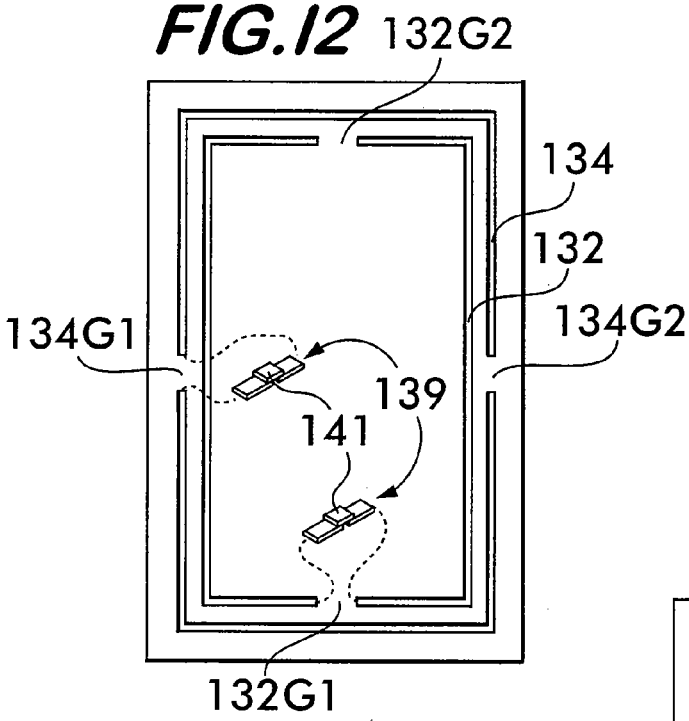
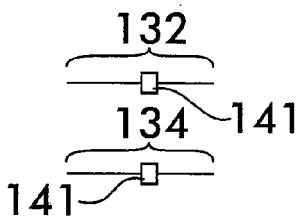
FIG.12A
FIG.13
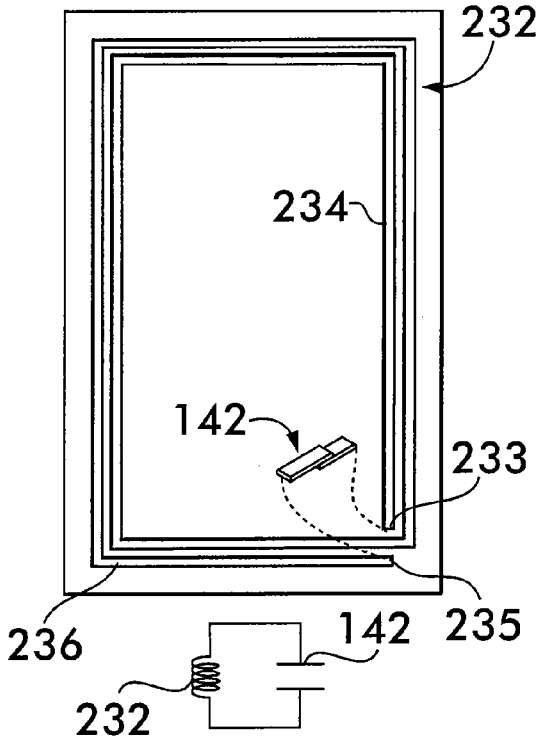
FIG.13A

SMART BLISTER PACK

CROSS-REFERENCE TO RELATED APPLICATIONS

This utility application claims the benefit under 35 U.S.C. §119(e) of Provisional Application Ser. No. 60/736,532 filed on Nov. 14, 2005 entitled SMART BLISTER PACK and whose entire disclosure is incorporated by reference herein.

BACKGROUND OF THE INVENTION

1. Field of Invention

The current invention relates to security tags and more particularly, discloses a blister pack that comprises an EAS or RFID coil or antenna as part of the metal layer (e.g., aluminum) seal and to which a capacitor strap or chip strap can be electrically coupled to form the EAS or RFID security tag.

2. Description of Related Art

Tracking or detecting the presence or removal of retail items from an inventory or retail establishment comes under the venue of electronic article surveillance (EAS), which also now includes radio frequency identification (RFID). EAS or RFID detection is typically achieved by applying an EAS or RFID security tag to the item or its packaging and when these security tags are exposed to a predetermined electromagnetic field (e.g., pedestals located at a retail establishment exit), they activate to provide some type of alert and/or supply data to a receiver or other detector.

However, the application of the EAS or RFID security tag to the item or its packaging in the first instance can be expensive and wasteful of resources used to form the security tag. For example, EAS security tags, typically comprise a resonant circuit that utilize at least one coil and at least one capacitor that operate to resonate when exposed to a predetermined electromagnetic field (e.g., 8.2 MHz) to which the EAS tag is exposed. By way of example only, the coil and the capacitor are etched on a substrate whereby a multi-turn conductive trace (thereby forming the coil) terminates in a conductive trace pad which forms one plate of the capacitor. On the opposite side of the substrate another conductive trace pad is etched to form the second capacitor plate, while an electrical connection is made through the substrate from this second plate to the other end of the coil on the first side of the substrate; the non-conductive substrate then acts as a dielectric between the two conductive trace pads to form the capacitor. Thus, a resonant circuit is formed. Various different resonant tag products are commercially available and described in issued patents, for example, U.S. Pat. Nos. 5,172,461; 5,108,822; 4,835,524; 4,658,264; and 4,567,473 all describe and disclose electrical surveillance tag structures. However, such products utilize, and indeed require, substrates which use patterned sides of conductive material on both face surfaces of the substrate for proper operation. Special conductive structures and manufacturing techniques must be utilized on both substrate faces for producing such resonant tag products. Currently available EAS tag structures have numerous drawbacks. For example, since special patterning and etching techniques must be utilized on both sides of the available tags to produce the proper circuit, per unit processing time and costs are increased. Furthermore, the complexity of the manufacturing machinery required for production is also increased. Oftentimes, complex photo-etching processes are used to form the circuit structures. As may be appreciated, two sided photo-etching is generally time consuming and requires precise alignment of the patterns on both sides. Additional material is also necessary to pattern both sides, thus increasing the per unit material costs.

With particular regard to radio frequency identification (RFID) tags, RFID tags include an integrated circuit (IC) coupled to a resonant circuit as mentioned previously or coupled to an antenna (e.g., a dipole) which emits an information signal in response to a predetermined electromagnetic field (e.g., 13.56 MHz). Recently, the attachment of the IC has been accomplished by electrically-coupling conductive flanges to respective IC contacts to form a "chip strap." This chip strap is then electrically coupled to the resonant circuit or antenna. See for example U.S. Pat. Nos. 6,940,408 (Ferguson, et al.); 6,665,193 (Chung, et al.); 6,181,287 (Beigel); and 6,100,804 (Brady, et al.).

Applying such EAS or RFID security tags to pharmaceutical blister packs is challenging because of the blister pack construction. A typical pharmaceutical blister pack comprises pills, tablets, or capsules that are positioned inside a plastic or paper tray which is then heat sealed with an aluminum layer. The presence of the aluminum layer can affect EAS or RFID security tag performance. Thus, there remains a need for more efficiently providing or integrating a security tag on or with items and/or their packaging where an aluminum layer is associated with the item and/or its packaging.

All references cited herein are incorporated herein by reference in their entireties.

BRIEF SUMMARY OF THE INVENTION

A blister pack comprising: non-conductive layer comprising a plurality of compartments holding respective elements (e.g., pills, tablets, capsules, etc.) and located substantially within a central region of the non-conductive layer (e.g., polystyrene) and wherein the non-conductive layer further comprises at least one channel running through a margin region that surrounds the central region; a metal layer (e.g., aluminum) that is sealed over the central region for securing the elements within the plurality of compartments; and a security tag (e.g., an EAS security tag, an RFID security tag) positioned within the at least one channel.

A method for integrating a security tag (e.g., an EAS security tag, an RFID security tag) in a blister pack having a non-conductive layer (e.g., polystyrene) having a plurality of compartments holding respective elements (e.g., pills, tablets, capsules, etc.) therein and located substantially within a central region of the non-conductive layer and wherein a metal layer (e.g., aluminum) is sealed over the non-conductive layer. The method comprises the steps of: forming at least one channel in a margin region surrounding the central region before the metal layer is sealed over the non-conductive layer; sealing the metal layer over the non-conductive layer; severing a portion of the metal layer that is positioned over the at least one channel; disposing the severed portion within the at least one channel; creating a gap in a portion of the severed portion; and electrically coupling a capacitor or a radio frequency identification (RFID) integrated circuit across the gap.

A blister pack comprising: a non-conductive layer (e.g., polystyrene) comprising a plurality of compartments holding respective elements (e.g., pills, tablets, capsules, etc.) and located substantially within a central region of the non-conductive layer and wherein the non-conductive layer comprises a margin region that surrounds the central region; a metal layer (e.g., aluminum) that is sealed over the central region for securing the elements within the plurality of compartments; and a security tag (e.g., an EAS security tag, an RFID security tag) coupled to the non-conductive layer in the margin region.

A method of producing a blister pack comprising an integrated security tag or inlay formed of a metal layer and wherein the blister pack comprises non-conductive layer having a plurality of compartments holding respective elements therein and located substantially within a central region of the non-conductive layer and defining a margin region surrounding the central region. The method comprises the steps of: applying a patterned adhesive to the margin region of the non-conductive layer and to the central region, wherein the patterned adhesive applied in the margin region has the form of at least one loop having two respective ends; applying a metal layer to the non-conductive layer having the patterned adhesive thereon; cutting the metal layer in the form of at least one loop having two respective ends to form a coil or antenna in the margin region; removing all portions of the metal layer that are not coupled to the non-conductive layer by any portion of the patterned adhesive; and coupling a capacitor or a radio frequency identification (RFID) integrated circuit across across different portions of said at least one loop (e.g., the two respective ends of the at least one loop).

BRIEF DESCRIPTION OF SEVERAL VIEWS OF THE DRAWINGS

The invention will be described in conjunction with the following drawings in which like reference numerals designate like elements and wherein:

FIG. 10 is a plan view of the conductive traces that form either the coil or antenna in the aluminum seal of the blister pack with a capacitor strap being electrically coupled across a gap in the coil to form a security tag;

FIG. 10A depicts the equivalent circuit of the circuit formed by the security tag of FIG. 10;

FIG. 11 is a plan view of a pair of concentric coils having respective capacitor straps applied respective gaps in the coils to form two security tags;

FIG. 11A depicts the equivalent circuit of the circuits formed by the security tags of FIG. 11;

FIG. 12 is a plan view of a pair of concentric dipole antennas having respective capacitor straps and an integrated circuit applied respective gaps in the dipole antennas to form two RFID security tags;

FIG. 12A depicts the equivalent circuits of the circuits formed by the security tags of FIG. 12;

FIG. 13 depicts a single EAS coil comprising a plurality of loops; and

FIG. 13A depicts the equivalent circuits of the circuits formed by the security tags of FIG. 13.

DETAILED DESCRIPTION OF THE INVENTION

Figure 2:
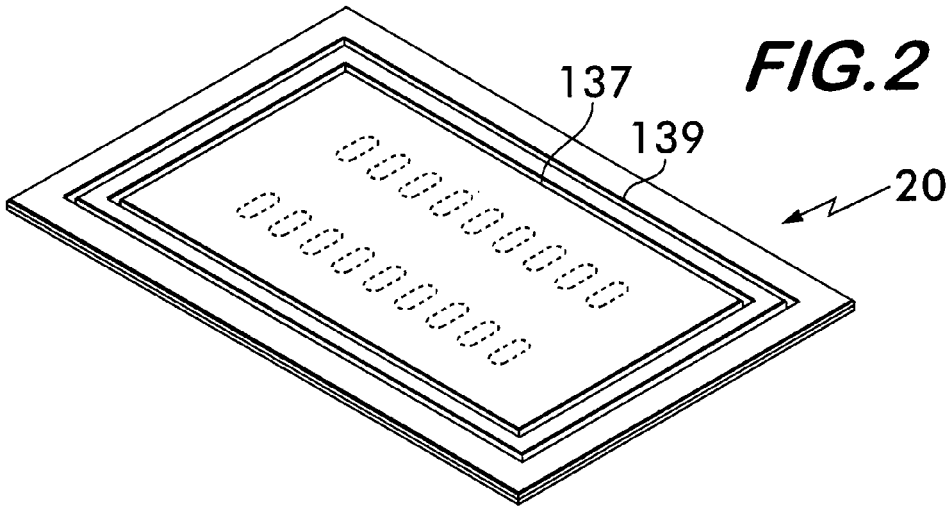
FIG. 2 is an isometric view of the smart blister pack of the present invention showing continuous concentric slices in the metal layer.

FIG. 2 provides an isometric view of the smart blister pack 20 of the present invention.

Figure 6:
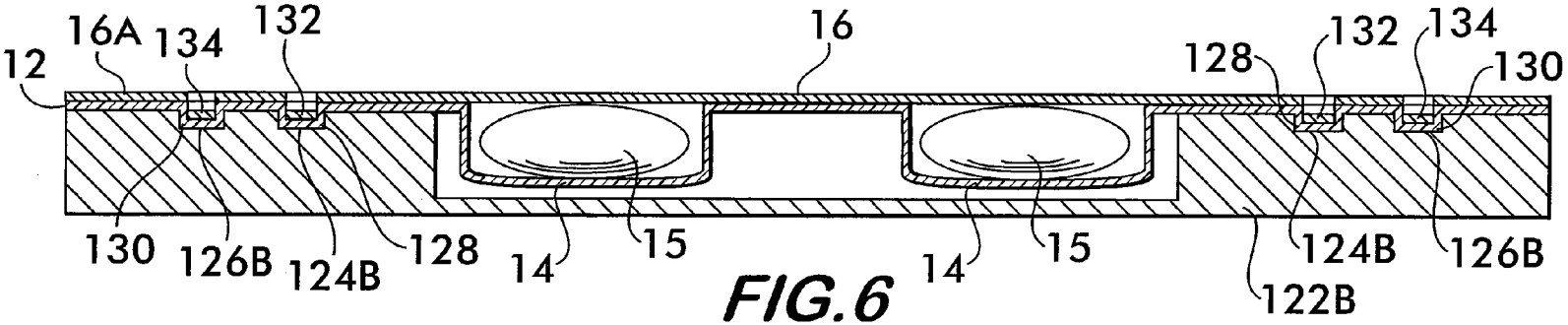
FIG. 6 is a cross-sectional view of the blister pack and the lower tool taken along line 6-6 of FIG. 1.

However, before the smart blister pack 20 is discussed in detail, the construction of a typical blister pack 10 (see FIG. 1) is discussed. As is well known, the blister pack 10 comprises a non-conductive layer (e.g., polystyrene) 12 comprising cavities 14 for holding respective contents 15 (FIG. 6), e.g., pills, tablets, capsules, etc. An aluminum layer 16 is then heat sealed over the non-conductive layer 12, thereby sealing the contents 15 therein. To remove one of the contents 15, a user need only apply pressure against the particular cavity 14 (FIG. 6) sufficient to rupture the aluminum layer 16 directly over the cavity 14 and the contents 15 is then exposed and ready for use or ingestion by the user.

The method of the present invention takes advantage of the portion 16A of the aluminum layer 16 that surrounds the array of cavities 14. Instead of applying an EAS or RFID tag to the blister pack 10, in the present invention the aluminum layer 16 is modified to contain the EAS or RFID tag therein. As will be described in detail later, tools are used to isolate a portion 16A of the aluminum layer 16 from the remainder of the aluminum layer 16 without compromising the seal of the cavities 14. This is accomplished by simultaneously severing an aluminum layer path along the outer portion or margin 16A of the blister pack 10 and then entrenching this severed path within the non-conductive layer 12. This path then forms an EAS coil, or an RFID antenna or dipole. It should be noted that more than one EAS coil or RFID antenna or dipole can be formed in the margin 16A of the aluminum layer 16, e.g., concentric coils or antennas or dipoles can be formed, as shown in FIGS. 11-12, by way of example only. Alternatively, an EAS coil can be formed in the blister pack 10 that may include a plurality of loops, such as that shown in FIG. 13.

Figure 1:
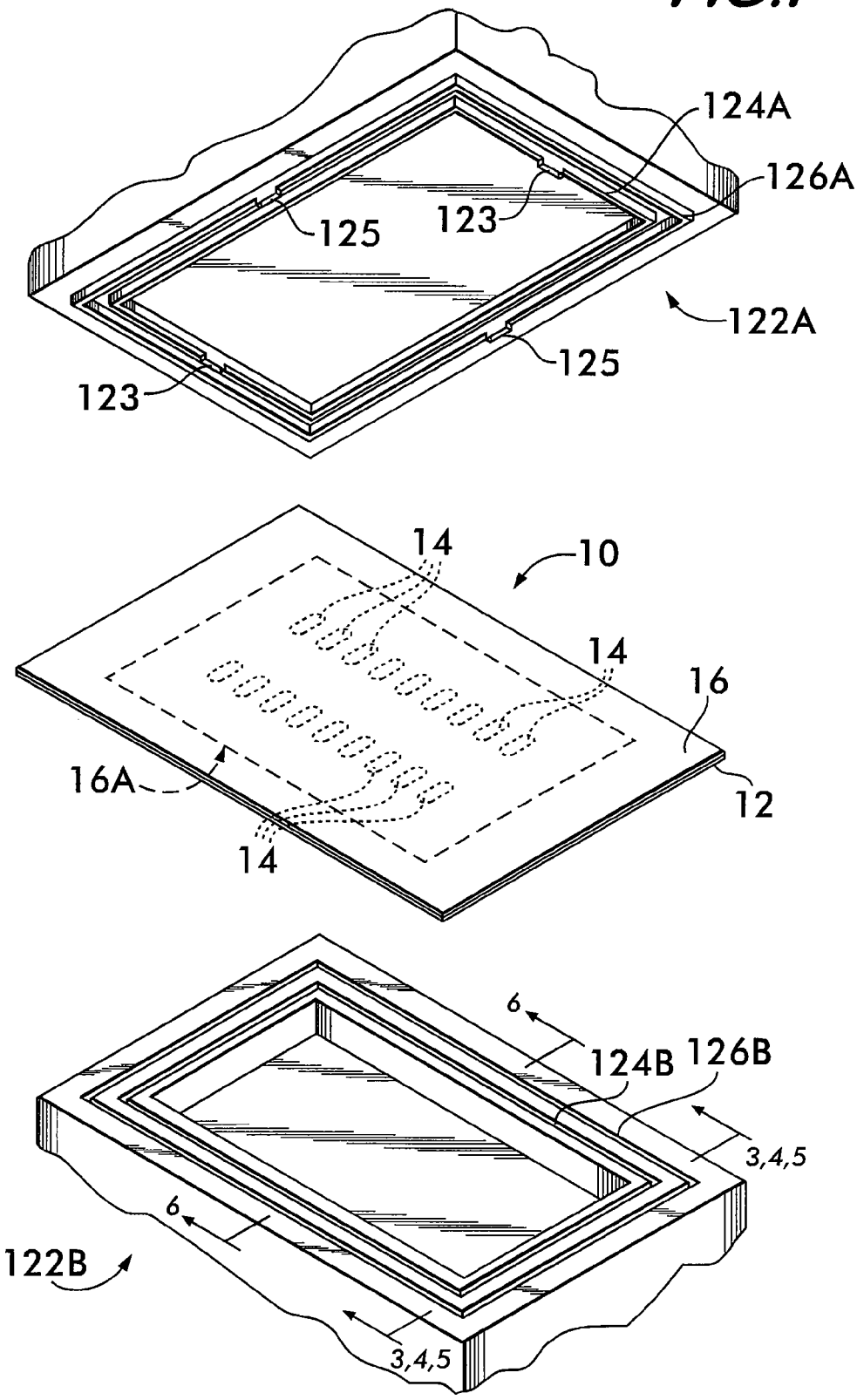
FIG. 1 is an exploded isometric view of an upper tool and lower tool that receive ablister pack therebetween and wherein the upper and lower tool sandwich the blister pack to form an EAS or RFID coil or antenna using the metal layer of the blister pack.

By way of example only, FIG. 1 depicts an exploded view of a tool used for forming a pair of security tags within the blister pack 10. In particular, the tool comprises an upper die 122A and a lower die 122B. The construction of the dies forms two concentric coils in the margin 16A of aluminum layer 16 but again, this is only by way of example. It should be understood that the term "margin" is used in its broadest sense and is not limited to the extreme sides of the blister pack 10; what is meant by the term "margin" 16A is that portion of the blister pack 10 that does not impact or disturb the normal operation or seal of the cavities 14.

Figure 2A:
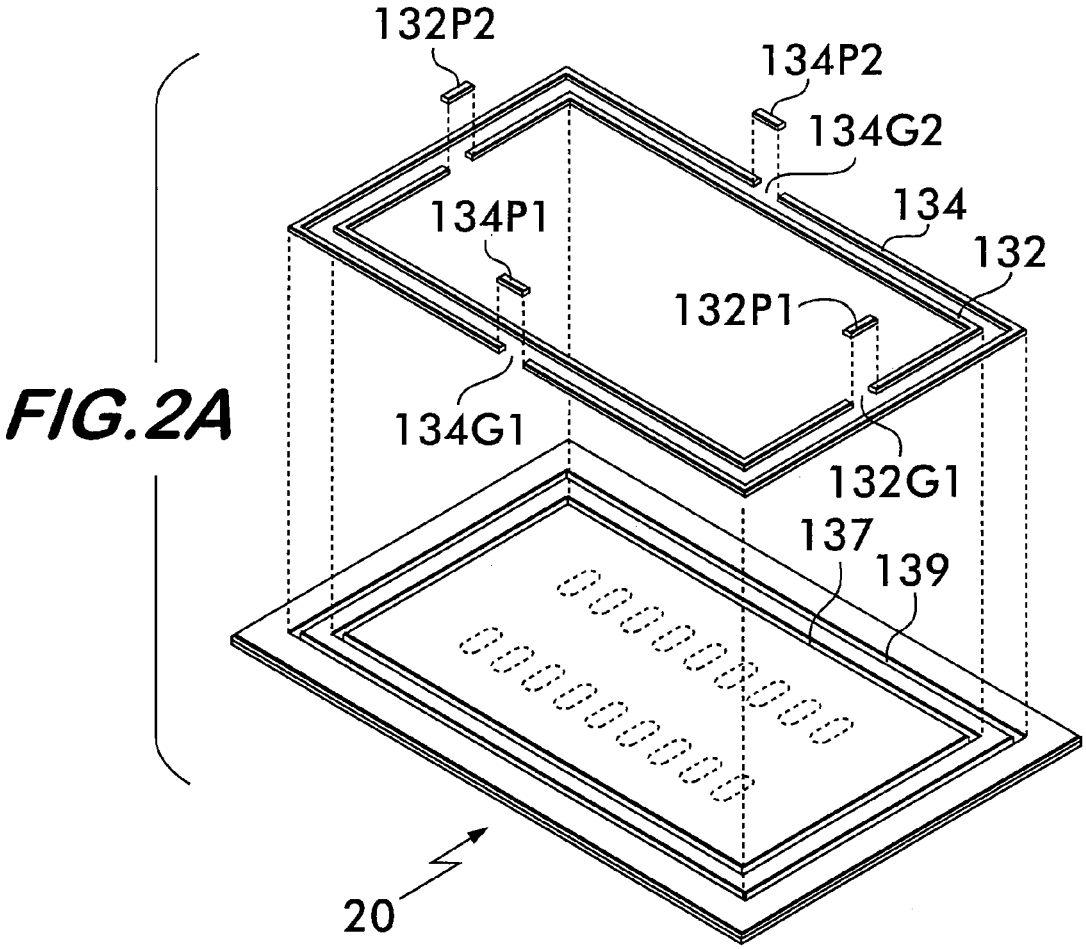
FIG. 2A is an exploded view showing the conductive traces, and removed portions of conductive traces or paths, that are positioned within the channels of the smart blister pack.

In particular, where a pair of security tags are desired, the lower die 122B comprises a pair of concentric troughs 124B and 126B and the upper die 122A comprises a corresponding pair of punches 124A and 126A. The punches 124A and 126A comprise knife edges that sever corresponding continuous paths 132 and 134 (see FIG. 2A) of aluminum from the margin 16A when the blister pack 10 is sandwiched between the upper and lower dies 122A/122B. It should also be noted that a plurality of respective projections 123 and 125 are provided at predetermined locations along the punches 124A and 126A. The projections 123 and 125, comprising cutting edges 133 (FIG. 4), sever respective portions 132P1, 132P2, 134P1 and 134P2 (see FIG. 2A) of the aluminum paths 132 and 134 created by the punches 124A and 126A, the purpose of which will be discussed later.

Figure 3:
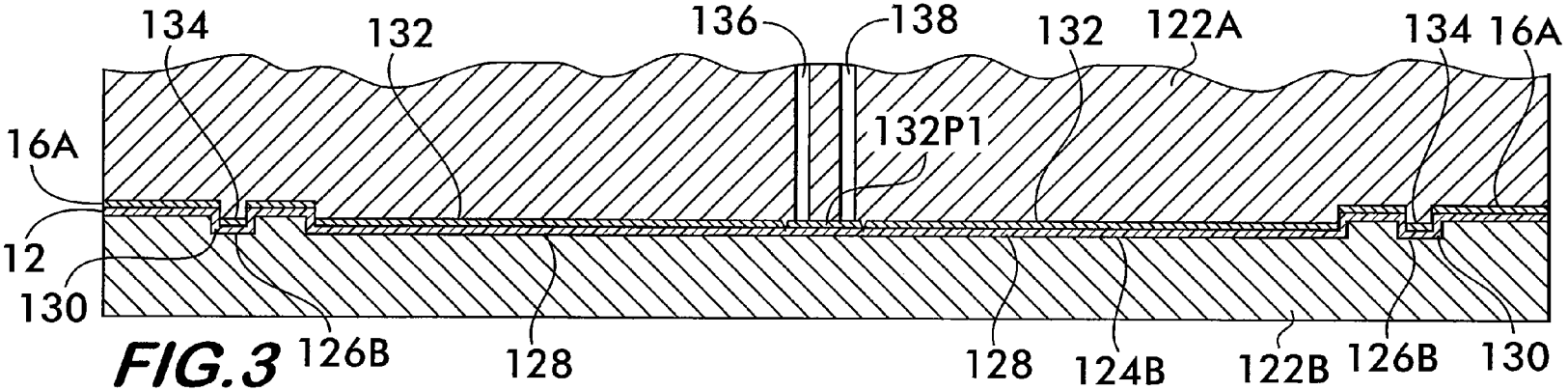
FIG. 3 is a cross-sectional view of the blister pack and combined tools (with the upper tool being shown in partial cross-section) taken along line 3-3 of FIG. 1 showing the upper tool severing portions of the aluminum seal of the blister pack to form the slices and recessed coils or antennas, while applying a vacuum to capture severed portions of the coils or antennas.
Figure 4:
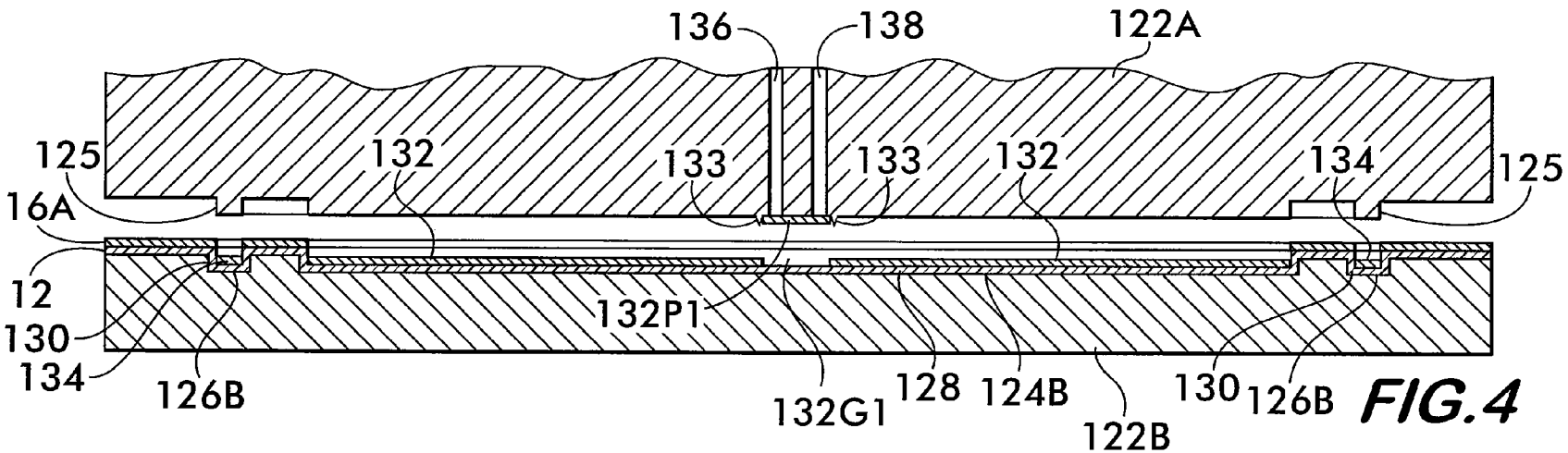
FIG. 4 is a cross-sectional view of the blister pack and the lower tool as the upper tool, shown in partial cross-section, has been lifted upward from the lower tool.

Also, the non-conductive layer 12 of the blister pack 10 itself comprises a corresponding pair of channels therein; one portion of the inner channel 128 is shown in FIGS. 3-4 and one portion of the outer channel 130 is also shown in FIGS. 3-4. Thus, when the blister pack 10, having the inner and outer channels 128/130 already formed in the layer 12, is positioned on the lower die 122B, the inner and outer channels 128/130 register with the inner troughs 124B and 126B, as shown in FIGS. 3-4. Next, the upper die 122A is then pressed downward onto the lower die 122B holding the blister pack 10. When the dies 122A/122B sandwich the blister pack 10, the punches 124A/126A sever the respective aluminum paths 132 and 134 from the margin 16A and entrenches them into the corresponding channels 128 and 130. At the same time, the projections 123 and 125 sever portions 132P1, 132P2, 134P1 and 134P2, that creates corresponding gaps 132G1, 132G2, 134G1 and 134G2 in the corresponding aluminum paths. As can most easily be seen in FIGS. 3-4, each of the projections 123 and 125 comprise lumens 136 and 138 that are coupled to a vacuum source (not shown). Thus, once the severed portions 132P1, 132P2, 134P1 and 134P2 are created, a vacuum is pulled directly against these severed portions 132P1, 132P2, 134P1 and 134P2 and as the upper die 122A is lifted upward (FIG. 4), the severed portions 132P1, 132P2, 134P1 and 134P2 are removed from the channels 128 and 130, thereby leaving the gaps 132G1, 132G2, 134G1 and 134G2 in the conductive paths 132 and 134. Thus, as shown in FIG. 2, the result is a pair of continuous concentric slices 137/139 in the margin 16A of the metal layer 16.

Figure 5:
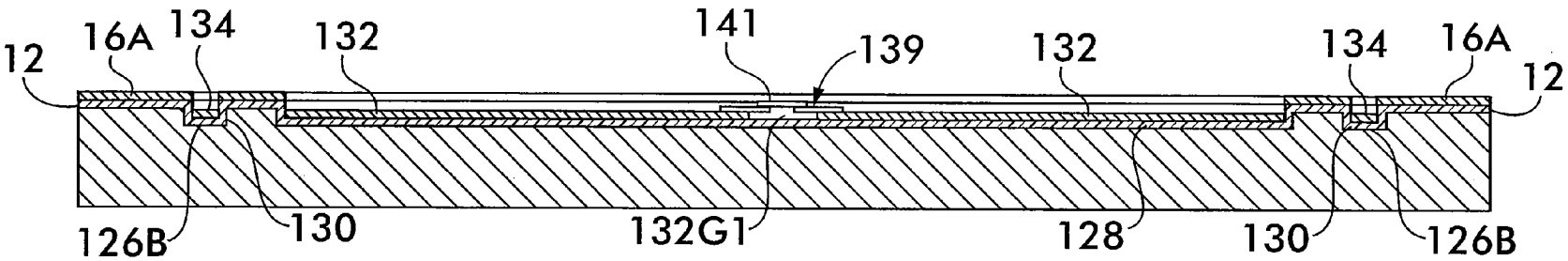
FIG. 5 is a cross-sectional view of the blister pack and the lower tool taken along line 5-5 of FIG. 1 and showing a chip strap being electrically coupled across one of the gaps in the coil or antenna.

The aluminum paths 132 and 134 positioned inside the channels 128 and 130 form respective dipoles for an RFID security tag. All that needs to be done is to electrically couple an RFID integrated circuit (IC) across one of the two gaps in each of the paths 132 and 134. The attachment of the RFID IC has been accomplished by electrically-coupling conductive flanges to respective IC contacts to form a "chip strap." This chip strap is then electrically coupled to the resonant circuit or antenna. See for example U.S. Pat. Nos. 6,940,408 (Ferguson, et al.); 6,665,193 (Chung, et al.); 6,181,287 (Beigel); and 6,100,804 (Brady, et al.), and all of whose entire disclosures are incorporated by reference herein. FIG. 5 depicts a "chip strap" 139 electrically coupled across the gap 132G1 where the RFID IC is shown at 141. As a result, the other gap, 132G2, forms the open ends of the dipole antenna which is the aluminum path 132. This can best be seen in FIG. 12. Similarly, another chip strap can be electrically coupled across one of the gaps 134G1 or 134G2 to form another RFID security tag where the aluminum path 134 forms the dipole antenna for that security tag. FIG. 12A depicts the equivalent circuit for these RFID security tags. Thus, each of the dipole antennas 132 and 134 are tuned to a respective RFID frequency selected from the RFID frequency bands (e.g., 2 MHz-14 MHz; 850 MHz-950 MHz; or 2.3 GHz-2.6 GHz, etc.). Depending on the frequency of an RFID reader (not shown) signal that is attempting communication with either of these RFID security tags, the RFID security tags will respond accordingly.

Alternatively, if only one gap is made in each aluminum path 132 and 134, then the aluminum paths form inductors or coils and a respective capacitor strap 142 can be electrically coupled across each coil gap, thereby forming a pair of EAS security tags, as shown in FIG. 11. A capacitor strap 142 is a thin film capacitor formed of two metal foils in between which is a dielectric material having ends that are electrically coupled to different points of a security tag coil or antenna. The capacitor strap 142 is then applied to security tag coil across the gap, thereby forming an inductor/capacitor resonant circuit tuned to a particular frequency. These capacitor straps 142 can be constructed such that when they are electrically coupled to a security tag coil the resultant resonant circuit is tuned to a particular frequency. The details of the capacitor strap (or chip strap mentioned previously) are discussed in U.S.A. Ser. No. 60/730,053 entitled Capacitor Strap filed on Oct. 25, 2005 and whose entire disclosure is incorporated by reference herein. FIG. 11A depicts the equivalent circuits for the two EAS security tags formed by the capacitor strap 142/coils 132 or 134. Thus, if the blister pack 20 is subjected to an EAS interrogator field and the EAS security tags in the blister pack 20 are tuned to respective frequencies (e.g., 8.2 MHz and 13.56 MHz) of the interrogator fields, the corresponding EAS security tag will respond.

Another embodiment includes only one security tag and thus only one aluminum path or coil 144 in the margin 16A, as shown in FIG. 10, and having a gap 146 across which a capacitor strap 142 is electrically coupled.

Based on the previous discussion of the construction of the upper and lower dies 122A/122B, one skilled in the art can appreciate how the upper and lower dies can be altered in order to generate these alternative security tag embodiments. In all of these embodiments, it should be understood that there must a corresponding channel in the non-conductive layer 12 of the blister pack 20.

FIG. 13 depicts a multi-turn or multi-loop coil 232 that is formed in a corresponding multi-turn channel (not shown) in the non-conductive layer 12 of the blister pack 20. A capacitor strap 142 can be applied to the open ends 233 and 235 off the coil 232 to form a resonant circuit. Alternatively, to tune the resulting resonant circuit, the ends of the capacitor strap 142 can be applied at different locations around the multi-turn coil by electrically connecting a portion of the inner path 234 of the multi-turn coil 232 to a portion of the outer path 236 of the multi-turn coil 232. In doing so, the capacitor strap 142 would be arched since its two ends would be electrically coupled to the inner and outer coil paths 234/236 which are recessed in respective channels.

Along those same lines, other variations included within the broadest scope of the present invention are the use of non-continuous channels whereby a capacitor strap 142 (or chip strap as mentioned earlier) would electrically couple the entrenched electrical metal paths between the non-continuous channels.

Figure 7:
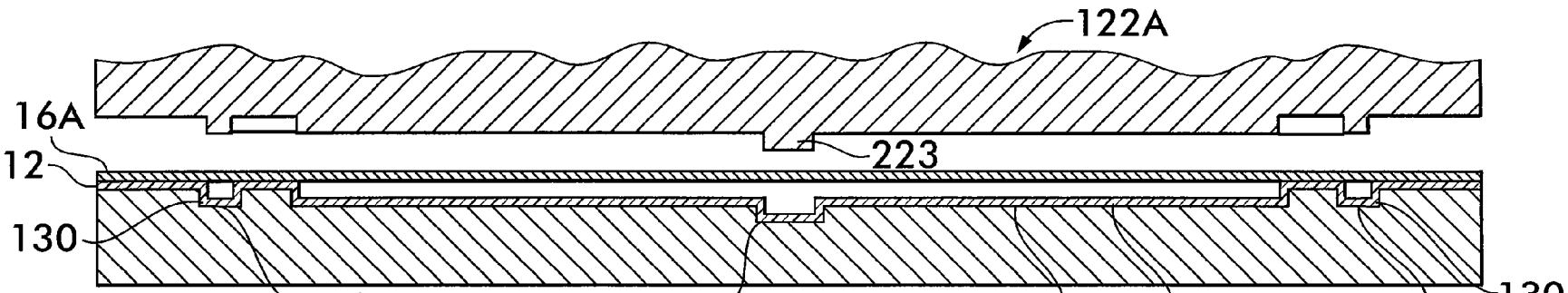
FIG. 7 is a cross-sectional view of an alternative embodiment of the blister pack and corresponding tooling (the upper tool being shown in partial cross-section) just prior to closure of the tools.
Figure 8:
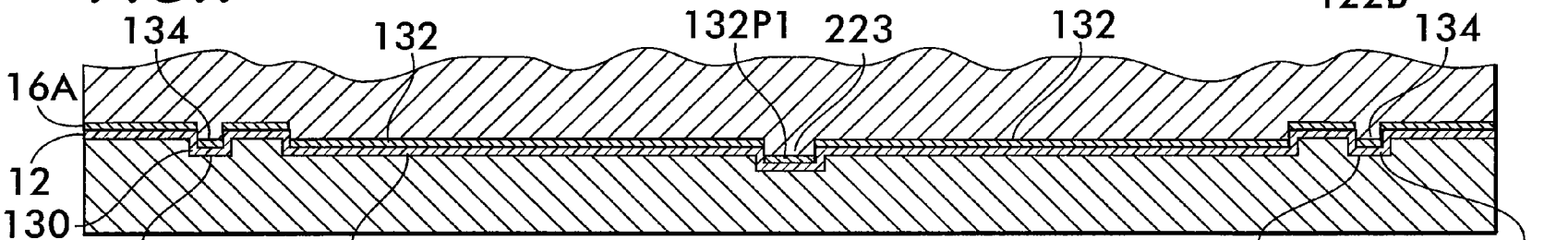
FIG. 8 is a cross-sectional view of the alternative embodiment of the blister pack depicting the closure of the corresponding tools and the recessing of the severed portion to form the gap(s) in the conductive paths.
Figure 9:
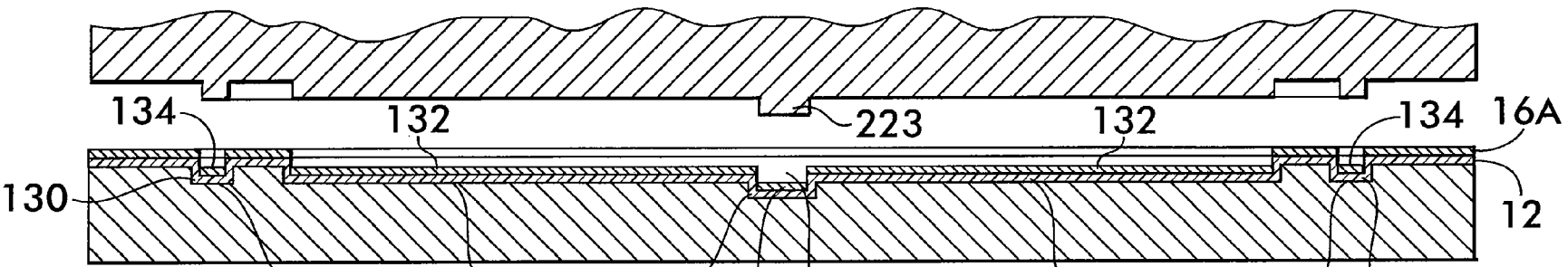
FIG. 9 is a cross-sectional view of the alternative embodiment of the blister pack still in the lower tool with the upper tool (shown in partial cross-section) being lifted upward from the lower tool.

An alternative way of generating the gaps in the entrenched aluminum paths 132 and 134 is shown in FIGS. 7-9. In particular, instead of applying a vacuum to remove the severed portions 132P1, 132P2, 134P1 and 134P2 from the channels 128 and 130, a recess 300 in the non-conductive layer 12 is provided so that a modified upper die punch member both severs these portions from the paths 132 and 134 and also displaces the severed portions into corresponding recesses 300 in the non-conductive layer 12. In particular, as can be seen in FIG. 7, a recess 300 is located at lower depth than the channels 128 and 130. Thus, the elongated cutter (only one 223 of which is shown) on the upper die 122A severs the a portion (e.g., 132P1) of the aluminum path 132 and as the upper die 122A continues downward against the lower die 122B, the cutter 223 continues to displace the severed portion 132P1 downward into the recess 300, as shown in FIG. 8. When the upper die 122A is then lifted upward and disengaged from the lower die 122B, the result is the gap 132G1 has been formed in the path 132 and the severed portion 132P1 is isolated from the path 132. Therefore, the projections 123 and 125 discussed with respect to FIGS. 1-6 in the upper die are replaced with elongated cutters 223 as shown in FIGS. 7-9.

It should be understood that it is within the broadest scope of the present invention to include the integration of the EAS coil or RFID antenna or dipole in the metal layer 16 without the use of a preformed channel in the non-conductive layer 12. Thus, in this embodiment, the EAS coil or RFID antenna or dipole would remain in the same plane as the metal layer 16. To accomplish this same plane EAS or RFID security tag, the process of sealing the metal layer 16 to the non-conductive layer 12 is modified using a patterned adhesive. Basically, an adhesive, patterned in the shape of the desired coil or antenna, would be applied to the non-conductive layer 12 in the region corresponding to the margin 16A; adhesive applied in the central region of the non-conductive layer 12 (where the cavities 14/contents 15 are located) would conform to the array formed thereat. The metal layer 16 is then applied to the non-conductive layer 12. A cutting die, shaped in the pattern of the desired coil or antenna corresponding to the margin 16A is then activated against the metal layer 16, thereby cutting the metal layer 16 so that any portion of the metal layer 16 that does not have any adhesive thereunder is no longer coupled to the non-conductive layer 12. Next, the severed portions of the metal layer 16 are removed, thereby leaving the central region (where the cavities 14/contents 15 are located) sealed with a metal layer while the margin 16A is formed into a coil, or multi-loop, or antenna having at least one gap. A capacitor strap 142 (or chip strap) can then be applied across the gap (or gaps) as discussed previously, with regard to the entrenched aluminum paths 132 and 134. The details of this patterned adhesive application and cutting procedure are provided in U.S. Pat. No. 7,119,685 entitled "A Method for Aligning Capacitor Plates in a Security Tag and a Capacitor Formed Thereby" filed on Nov. 29, 2004, and whose entire disclosure is incorporated by reference herein.

The term "inlay" as used throughout this Specification means that the completed tag (e.g., an EAS tag or RFID tag) may themselves either form a portion of a label or be coupled to a label for use on, or otherwise associated with, an item.

While the invention has been described in detail and with reference to specific examples thereof, it will be apparent to one skilled in the art that various changes and modifications can be made therein without departing from the spirit and scope thereof.

What is claimed is:

1. A blister pack comprising:

a non-conductive layer comprising a plurality of compartments holding respective elements and located substantially within a central region of said non-conductive layer, said non-conductive layer further comprising a channel running through a margin region that surrounds said central region;

a metal layer that is sealed over said central region for securing said elements within said plurality of compartments; and a security tag positioned within said channel, said security tag comprising:

a metal material that has been separated from said metal layer within said channel and wherein said metal material comprises a gap and wherein a radio frequency identification (RFID) circuit is electrically coupled across said gap.

2. The blister pack of claim 1 wherein said metal layer comprises aluminum.

3. The blister pack of claim 2 wherein said RFID integrated circuit comprises a chip strap.

4. The blister pack of claim 1 wherein said non-conductive layer comprises polystyrene.

5. The blister pack of claim 1 wherein said metal material comprises a second gap to form a dipole.

6. The blister pack of claim 1 wherein said RFID integrated circuit comprises a chip strap.

7. A blister pack comprising:

a non-conductive layer comprising a plurality of compartments holding respective elements and located substantially within a central region of said non-conductive layer, said non-conductive layer further comprising at least one loop channel running through a margin region that surrounds said central region;

a metal layer that is sealed over said central region and said margin region for securing said elements within said plurality of compartments; and a security tag positioned within said at least one loop channel and comprising a metal material therein, said metal material being separated from said metal layer and comprising at least one loop corresponding to said at least one loop channel, and wherein said separated metal material comprises a gap across which a capacitor is electrically coupled.

8. The blister pack of claim 7 wherein said capacitor comprises a capacitor strap.

9. A method for integrating a security tag in a blister pack having a non-conductive layer having a plurality of compartments holding respective elements therein and located substantially within a central region of the non-conductive layer and wherein a metal layer is sealed over the non-conductive layer, said method comprising:

forming at least one channel in a margin region of said non-conductive layer surrounding the central region before the metal layer is sealed over the non-conductive layer;

sealing the metal layer over the non-conductive layer;

severing a portion of the metal layer that is positioned over said at least one channel;

disposing said severed portion within said at least one channel;

creating a first gap and a second gap in said severed portion; and electrically coupling or a radio frequency identification (RFID) integrated circuit across only one of said two gaps.

10. The method of claim 9 wherein said RFID integrated circuit comprises a chip strap.

11. The method of claim 9 wherein said step of creating a first and second gaps said severed portion comprises:

severing a predetermined portion from said metal layer; and applying a vacuum to said severed predetermined portion to remove said severed predetermined portion from said channel.

12. The method of claim 9 wherein said step of forming at least one channel in a margin region further comprises forming a recess in said non-conductive layer that is adjacent said at least one channel and wherein said step of creating a gap in a portion of said severed portion comprises:

severing a predetermined portion from said metal layer; and displacing said severed predetermined portion into said recess to remove said severed predetermined portion from said channel.

13. A blister pack comprising:

a non-conductive layer comprising a plurality of compartments holding respective elements and located substantially within a central region of said non-conductive layer, said non-conductive layer comprising a margin region that surrounds said central region;

a metal layer that is sealed over said central region for securing said elements within said plurality of compartments; and a security tag formed within said margin region, said security tag comprising:

a metal material that has been separated from said metal layer of and wherein said metal material comprises a gap therein; and a radio frequency identification (RFID) integrated circuit coupled across said gap.

14. The blister pack of claim 13 wherein said separated metal material comprises a second gap to form a dipole.

15. The blister pack of claim 13 wherein said metal layer comprises aluminum.

16. The blister pack of claim 13 wherein said non-conductive layer comprises polystyrene.

17. The blister pack of claim 13 wherein said RFID integrated circuit comprises a chip strap.

18. A method of producing a blister pack comprising an integrated security tag or inlay formed of a metal layer and wherein the blister pack comprises non-conductive layer having a plurality of compartments holding respective elements therein and located substantially within a central region of the non-conductive layer and defining a margin region surrounding said central region, said method comprising:

applying a patterned adhesive to said margin region of said non-conductive layer and to said central region, said patterned adhesive applied in said margin region having the form of at least one loop having two respective ends;

applying a metal layer to said non-conductive layer having said patterned adhesive thereon;

cutting said metal layer in said form of at least one loop having two respective ends to form a coil or antenna in said margin region;

removing all portions of said metal layer that are not coupled to said non-conductive layer by any portion of said patterned adhesive; and coupling a capacitor across a gap in said at least one loop.

19. The method of claim 18 wherein said RFID integrated capacitor is a capacitor strap.

20. A method for integrating a security tag in a blister pack having a non-conductive layer having a plurality of compartments holding respective elements therein and located substantially within a central region of the non-conductive layer and wherein a metal layer is sealed over the non-conductive layer, said method comprising:

forming at least one loop channel in a margin region of said non-conductive layer surrounding the central region before the metal layer is sealed over the non-conductive layer;

sealing the metal layer over the non-conductive layer;

severing a portion of the metal layer that is positioned over said at least one loop channel to form an at least one loop from said severed portion of said metal layer disposing said severed portion within said multi-turn channel;

creating gap in a portion of said severed portion; and electrically coupling a capacitor across said gap to form a security tag positioned within said at least one loop channel.

21. The method of claim 20 wherein said step of creating a gap comprises a gap formed between two ends of said multi-turn coil.

22. A method of producing a blister pack comprising an integrated security tag or inlay formed of a metal layer and wherein the blister pack comprises non-conductive layer having a plurality of compartments holding respective elements therein and located substantially within a central region of the non-conductive layer and defining a margin region surrounding said central region, said method comprising:

applying a patterned adhesive to said margin region of said non-conductive layer and to said central region, said patterned adhesive applied in said margin region having the form of at least one loop;

applying a metal layer to said non-conductive layer having said patterned adhesive thereon;

cutting said metal layer in said form of at least one loop having a gap therein to form an antenna in said margin region;

removing all portions of said metal layer that are not coupled to said non-conductive layer by any portion of said patterned adhesive; and coupling a radio frequency identification (RFID) integrated circuit across said gap.

23. The method of claim 22 wherein said step of creating a gap further comprises creating a second gap to form a dipole.

24. The method of claim 22 wherein said RFID integrated circuit comprises a chip strap.

* * * * *

UNITED STATES PATENT AND TRADEMARK OFFICE

CERTIFICATE OF CORRECTION

PATENT NO. : 7,623,040 B1
APPLICATION NO. : 11/549795
DATED : November 24, 2009
INVENTOR(S) : Andre Cote It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 408 days.

Signed and Sealed this

Twenty-sixth Day of October, 2010

David J. Kappos

David J. Kappos
*Director of the United States Patent and Trademark Office*